United States Patent [19]

Bastian

[11] Patent Number: 4,915,316

[45] Date of Patent: Apr. 10, 1990

[54] PAPER ROLL HOLDER

[75] Inventor: Lehyman J. Bastian, Media, Pa.

[73] Assignee: Scott Paper Company, Philadelphia, Pa.

[21] Appl. No.: 775,458

[22] Filed: Sep. 12, 1985

[51] Int. Cl.[4] ..... B65H 75/00

[52] U.S. Cl. ..... 242/55.2

[58] Field of Search ..... 242/55.2; D6/522; 40/10 D

[56] References Cited

U.S. PATENT DOCUMENTS

| | | | |
|---|---|---|---|
| D. 161,199 | 12/1950 | Perelman | D 6/522 |
| 2,214,030 | 9/1940 | Pereles | 40/10 D |
| 3,038,676 | 6/1962 | Mayer | 242/55.2 |
| 3,192,548 | 7/1965 | Vilbrecht | 242/55.2 X |
| 3,239,156 | 3/1966 | Castellano | 242/55.2 |
| 3,417,935 | 12/1968 | Douglas et al. | 242/55.2 |
| 3,561,146 | 2/1971 | Dembar | 40/10 D X |
| 4,244,512 | 1/1981 | Wise | 40/10 D X |
| 4,275,518 | 6/1981 | Martin | 40/10 D X |
| 4,291,475 | 9/1981 | Schoemer | 40/10 D X |
| 4,310,976 | 1/1982 | Wilten | 40/10 D X |

*Primary Examiner*—Joseph J. Hail, III

*Attorney, Agent, or Firm*—Nicholas J. DeBenedictis; John W. Kane, Jr.

[57] ABSTRACT

A paper roll holder, the decoration of which can be easily changed. The paper roll holder has a back bar adapted to be mounted to a surface. A bracket having a journal that can extend into a core of the paper roll for supporting the towel roll is connected to at least one end of the back bar. Decorative inserts overlie an area of the bracket and a transparent cover secured to the bracket overlies the decorated area of the bracket.

5 Claims, 3 Drawing Sheets

PAPER ROLL HOLDER

TECHNICAL FIELD

This invention relates generally to a paper roll holder. More particularly it relates to a paper roll holder, the decorative appearance of which can be readily changed by the user.

BACKGROUND ART

A typical paper roll holder is illustrated in U.S. Design patent 161,199, issued to A. A. Perelman and assigned to the assignee of this invention. The Perelman patent discloses a paper towel roll holder comprising a back bar having an end bracket hingedly connected to each end of the back bar. The back bar can be attached to a wall surface and each end bracket includes a journal that can extend into the core of the towel roll to support the towel roll in the holder.

Another typical towel roll holder is described in U.S. Pat. No. 3,038,676 issued to J. W. Mayer. As described at column 4, lines 35–62, Mayer discloses a towel roll holder having a two-piece end bracket hingedly connected to each end of a back bar. Each end bracket consists of a main body and a liner having a journal for supporting the towel roll, the liner being permanently secured to the main body of the end bracket.

The prior art towel roll holders are generally made out of molded plastic material and are available in several colors so that a user can select a color that matches appliances in the room or otherwise fits in with the decoration of the area around the towel roll holder. If the user redecorates the area around the towel holder, the original color of the towel holder may not fit in with the new decoration with the result that the user will have to buy a new towel holder to match the new decoration.

It is, therefore, the object of this invention, to provide a paper roll holder which can easily be redecorated.

DISCLOSURE OF THE INVENTION

In accordance with this invention, there is provided a paper roll holder, the decorative appearance of which can be easily changed. The paper roll holder has a back bar adapted to be mounted to a wall. Connected to each end of the back bar is a bracket having a journal that can extend into a core of the paper roll for supporting the towel roll. The paper roll holder also has a transparent cover secured to each bracket for overlying an area of the bracket to be decorated. The decoration of the paper roll holder is achieved by means of decorative inserts placed between each transparent cover and its respective bracket. The transparent covers can be easily removed from the brackets to change the decorative inserts.

In one embodiment of the paper roll holder, the exterior face of each bracket includes a recessed ridge defining an area to be decorated and the decorative inserts are in the shape of said defined area and supported by the recessed ridge.

In another embodiment of the paper roll holder, each bracket has an interior face, an exterior face and edges. The decorative inserts cover the exterior face and edges of the brackets and each cover overlies the exterior face and the edges of its respective decorated bracket.

BRIEF DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

BEST MODE FOR CARRYING OUT THE INVENTION

Figure 1:
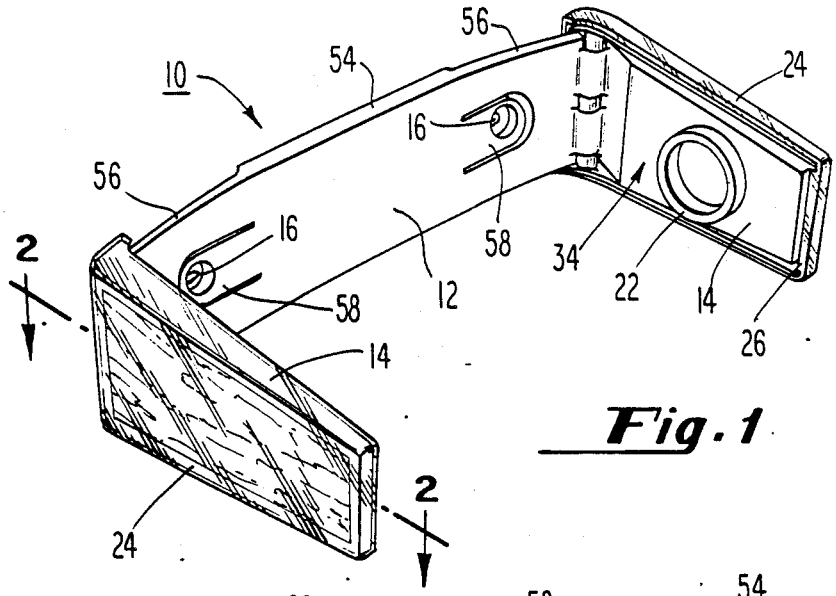
FIG. 1 is a perspective view of the paper roll holder.

For the sake of convenience an element depicted in more than one figure will retain the same element number in each figure. FIG. 1 depicts an assembled paper roll holder 10 in accordance with this invention. The paper roll holder 10 consists of a back bar 12 and two end bracket assemblies 14 connected to each end of the back bar 12. Each end bracket assembly 14 has a journal 22 which extends into the core of a paper roll, such as a roll of paper towels, to support the roll in the holder 10. The back bar 12 includes two mounting holes 16 for receiving screws which can be used to secure the holder 10 to a wall or other mounting surface.

Figure 2:
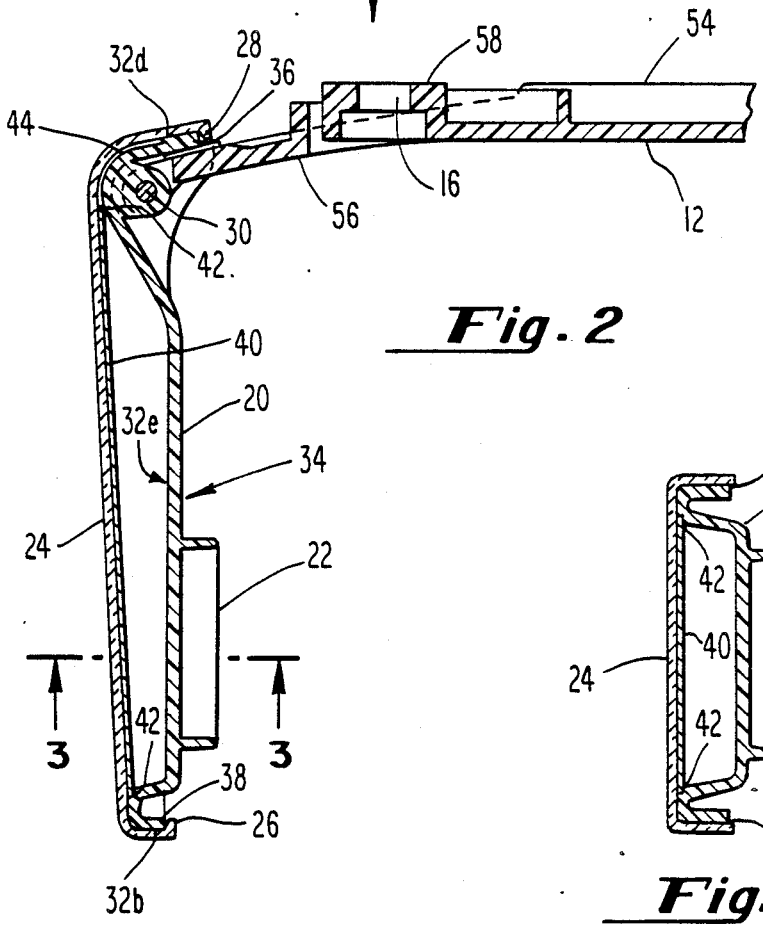
FIG. 2 is a partial section taken along the line 2—2 of FIG. 1.

The back bar 12 has been designed so that the paper roll product can be placed in the holder 10 while it remains secured to the wall. Thus, as best shown in FIGS. 1 and 2, the back bar 12 has a straight central portion 54 and straight central extensions 58 that include the mounting holes 16 which mount against a wall surface. The back bar 12 also includes an end wing portion 56 connected to each end of straight central portion 54, each end wing portion 56 curving away from the wall surface. When a paper roll is in the holder 10, bracket 20 is in the approximate position depicted in FIG. 2 with its rear edge **32*d* contacting or nearly contacting the rear edge of end wing portion 56 of back bar 12. In that position, journal 22 extends slightly into the core of the roll to support the roll in the holder 10. In order to install a new roll into the holder 10, it is necessary to spread the bracket assemblies 14 apart slightly. As a spreading force is applied to the end bracket assemblies 14, the rear edge 32*d* of each bracket 20 contacts the rear surface of the slightly flexible end wing sections 56 causing them to bend toward the wall surface, thereby allowing the end bracket assemblies 14 to be spread apart sufficiently for a new roll to be placed over the supporting journal 22**.

Figure 3:
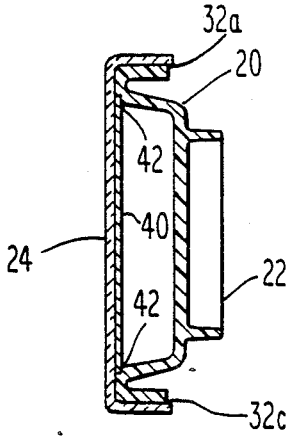
FIG. 3 is a section taken along the line 3—3 of FIG. 2.

Referring now to FIGS. 2 and 3, a preferred embodiment of the end bracket assembly 14 is shown as comprising a bracket member 20, a decorative insert 40 and a transparent cover 24. Each bracket member 20 is connected to one end of back bar 12 by means of hinge pin 30 and includes a journal 22 which extends into the core of a paper roll (not shown). The bracket member 20 is depicted as having an interior face 34 and an exterior face 32 which comprises top edge 32*a*, front edge 32*b*, bottom edge 32*c*, rear edge 32*d*, and end surface 32*e*. A major portion of exterior end surface 32*e* is covered by decorative insert 40. Cover 24 is made out of a transparent material, preferably plastic, so that the decorative insert 40 is clearly visible through the cover 24.

Figure 5:
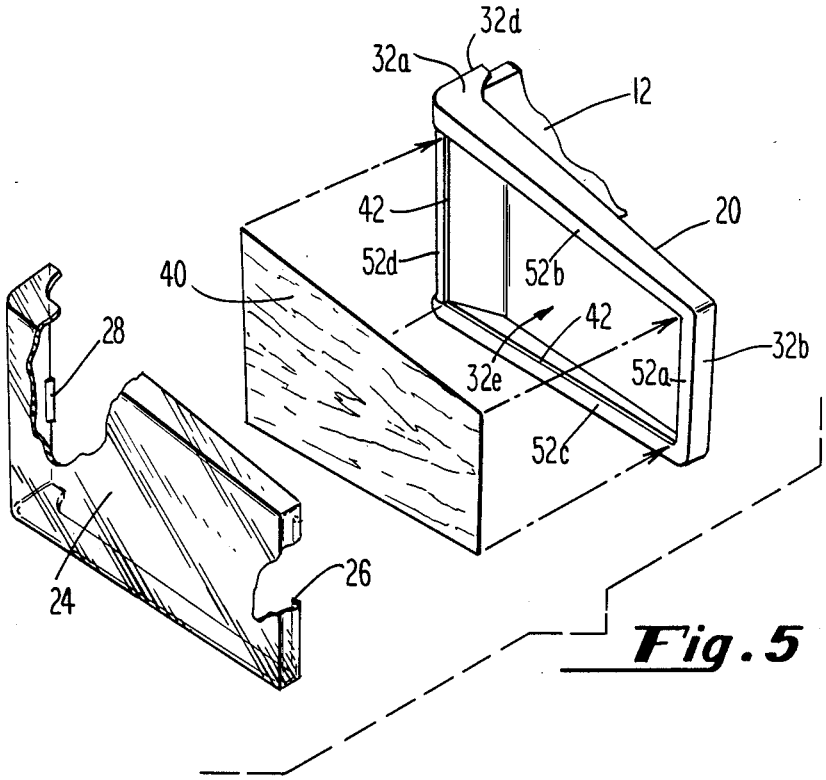
FIG. 5 illustrates one shape of decorative insert that can be used with the paper roll holder.

As best shown in FIG. 5, the end surface 32*e* of the bracket member 20 includes a recessed ridge 42 which defines an area of end surface 32*e* which is to be decorated. The undecorated portions of end surface 32*e* include front border 52*a*, top border 52*b*, bottom border 52*c* and rear border 52*d*. The depth of ridge 42 is approximately equal to the thickness of decorative insert 40 so that the exterior surface of decorative insert is practically flush with the surface of borders 52*a*, 52*b* and 52*c*. It is also preferred that the transparent cover 24 overlies end surface 32*e* and exterior edges 32*a*–32*d*. As best seen in FIGS. 2 and 5, the front interior edge of transparent cover 24 has a rearward extending projection 26 that snaps over the front interior edge 38 of bracket 20 and the rear interior edge of transparent cover 24 has a frontward extending projection 28 that snaps over the rear interior edge 36 of bracket 20. The projections 26 and 28 secure the transparent cover 24 to the bracket 20, but because of the flexibility of cover 24, it can be easily removed if it is desired to change the decorative insert 40.

Figure 6:
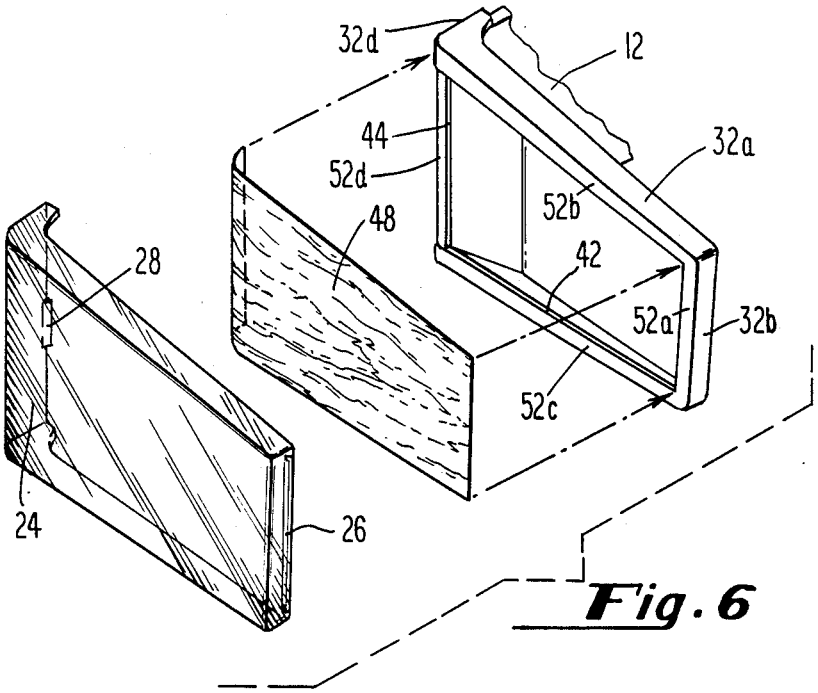
FIG. 6 illustrates an alternate shape of decorative insert that can be used with the paper roll holder.

FIG. 6 shows an alternate decorative insert 48 that can be used to decorate end bracket assemblies 14. The decorative insert 48 rests on the linear segments of recessed ridge 42 adjacent borders 52*a*, 52*b* and 52*c* but extends around rear border 52*d* to either partially or totally cover the rear edge 32*d* of the bracket 20.

Figure 7:
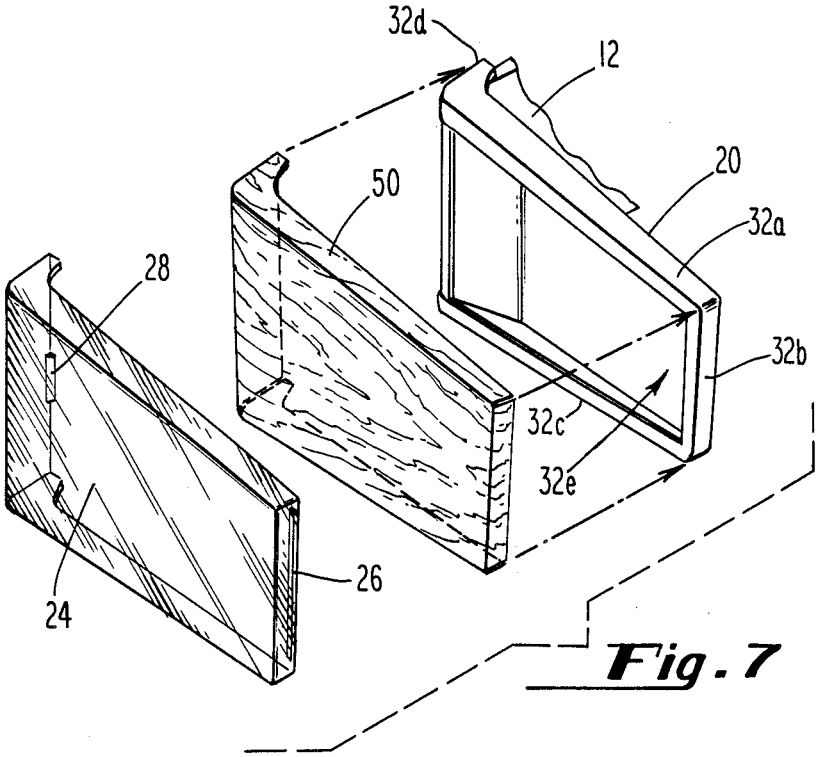
FIG. 7 illustrates another alternate shape of decorative insert that can be used with the paper roll holder.

FIG. 7 shows another alternate decorative insert 50 that covers the entire end surface 32*e* and all of the exterior edge surfaces 32*a*–32*d* of the bracket 20.

Figure 4:
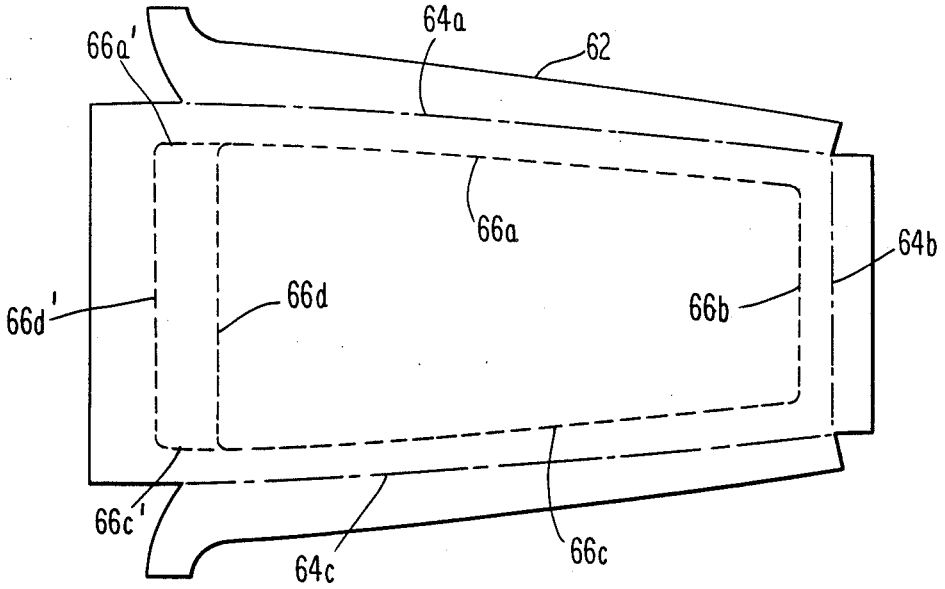
FIG. 4 is a plan view of a template or decorative insert for use with the paper roll holder.

FIG. 4 illustrates a blank 62 which can be folded into the shape of decorative insert 50 and can be used to make templates for decorative inserts 40 and 48. One side of blank 62 has a decorative finish, for example, a wood grain finish, while the other side can have printed thereon the dashed lines 64, 65 and 66. When the blank is folded along dashed lines 64*a*, 64*b* and 64*c*, it will be in the shape of decorated insert 50. The blank 62 will also serve as a template for a different decorative insert 50 if it is desired to change the decorative appearance of the paper roll holder 10. A central portion of blank 62 can be removed by cutting along lines 66*a*–66*d* to form either a decorative insert 40 or a template for a new decorative insert 40. Similarly, a central portion of blank 62 can be removed by cutting along lines 66*a*, 66*b*, 66*c*, 66*c*', 66*d*', and 66*a*' to form decorative insert 48 or a template for a new decorative insert 48.

While the present invention has been described with reference to a particular embodiment thereof, it will be obvious to those skilled in the art that various changes and modifications may be made without departing from the invention in its broadest aspects. For example, the decorative insert can be a piece of paper or cloth material or can be any suitable decorative object such as a dried flower. As another example, although brackets 20 have been described as being connected to the end wing portions 56 of back bar 12 by means of hinge pins 30, it will be apparent to those skilled in the art that brackets 20 can be permanently connected at right angles to back bar 12. Also, although the preferred embodiment includes two bracket assemblies 14, it will be apparent to one skilled in the art that paper roll holder 10 can have a single bracket assembly 14 having connected to it an extended journal 22, which may or may not be fixedly attached, for supporting a roll. It is contemplated in the appended claims to cover all variations and modifications of the invention which come within the true spirit and scope of my invention.

What is claimed as new and desired to be secured by Letters Patent of the United States is:

1. A paper roll holder and decorating system comprising:
   (a) a back bar adapted to be mounted to a surface;
   (b) a pair of brackets each having an interior face an exterior face and edges and each having a journal that can extend into a core of the paper roll for supporting the paper roll;
   (c) means for hingedly connecting each bracket to one end of the back bar;
   (d) a transparent cover removably secured to each bracket for overlaying the exterior face and the edges of each bracket; and
   (e) two decorative inserts each placed between a cover and its respective bracket so as to decorate the exterior face and edges of each bracket.

2. A paper roll holder and decorating system as recited in claim 1 wherein the exterior face of each bracket includes a recessed ridge defining an area to be decorated.

3. A paper roll holder and decorating system as recited in claim 2 wherein the decorative inserts have lines printed thereon defining a portion of the decorative inserts to be placed in the area of each bracket defined by the recessed ridge.

4. A paper roll holder and decorating system as recited in claim 3 wherein the decorative inserts have additional lines printed thereon defining a portion of the decorative inserts that will cover selected areas of each bracket.

5. A paper roll holder and decorating system as recited in claim 2 wherein at least one of the decorative inserts has lines printed thereon defining a template for a decorative insert to be placed in the area defined by the recessed ridge.

* * * * *